US005295597A

United States Patent [19]

Green

[11] Patent Number: 5,295,597

[45] Date of Patent: Mar. 22, 1994

[54] INFANT'S BOTTLE WITH VALVED CAP

[76] Inventor: Richard D. Green, 12979 Culver Blvd., Los Angeles, Calif. 90066

[21] Appl. No.: 6,789

[22] Filed: Jan. 21, 1993

[51] Int. Cl.[5] ..... A61J 9/00; A61J 11/04

[52] U.S. Cl. ..... 215/11.4; 215/11.1; 215/228; 220/711; 220/714

[58] Field of Search ..... 215/11.1-11.6, 215/229, 311; 220/703-709, 711, 714; 222/211, 522, 524; 224/35, 148; D9/310; D7/301; D24/194-199

[56] References Cited

U.S. PATENT DOCUMENTS

| | | | |
|---|---|---|---|
| D. 179,215 | 11/1956 | Prisament | D24/195 |
| D. 183,668 | 10/1958 | Whalen | D24/195 |
| D. 189,012 | 10/1960 | Sepe et al. | D24/199 |
| D. 189,880 | 3/1961 | Blake | D24/195 X |
| D. 192,391 | 3/1962 | Kolb | D9/310 |
| D. 272,797 | 2/1984 | Silva | D9/310 X |
| D. 330,939 | 11/1992 | Imai | D24/198 |
| 2,083,156 | 6/1937 | McCabe | 215/311 X |
| 2,372,281 | 3/1945 | Jordan | 215/11.5 |
| 2,792,161 | 5/1957 | Thomas | 222/522 |
| 2,793,776 | 5/1957 | Lipari | 215/11.1 X |
| 2,807,384 | 9/1957 | Lipari | 215/11.1 |
| 2,827,191 | 3/1958 | Baracate | 215/11.4 |
| 3,126,116 | 3/1964 | Clinehens | 215/11.1 |
| 3,157,323 | 11/1964 | Kitterman | 215/311 X |
| 3,366,261 | 1/1968 | Dewey | 215/11.4 |
| 4,600,111 | 7/1986 | Brown | 215/11.1 X |
| 4,850,496 | 7/1989 | Ruddell et al. | 220/717 X |
| 4,898,291 | 2/1990 | Sailors | 215/11.5 X |
| 4,979,648 | 12/1990 | Montgomery et al. | 222/522 X |
| 5,029,719 | 7/1991 | Solomon | 220/707 X |
| 5,085,335 | 2/1992 | Carbaugh | 215/1 A X |
| 5,145,094 | 9/1992 | Perlmutter | 215/311 X |
| 5,150,800 | 9/1992 | Sarter et al. | 215/11.4 |
| 5,211,300 | 5/1993 | Hsing et al. | 215/11.4 |
| 5,234,117 | 8/1993 | Garvin | 215/11.4 |

FOREIGN PATENT DOCUMENTS

| | | | |
|---|---|---|---|
| 109728 | 1/1984 | European Pat. Off. | 215/311 |

*Primary Examiner*—Sue A. Weaver

*Attorney, Agent, or Firm*—Kelly, Bauersfeld & Lowry

[57] ABSTRACT

An infant's bottle is provided with a valved cap adapted for quick and easy movement between open and closed positions. The valved cap includes a base member mounted by a threaded neck ring or the like over the mouth of a beverage container such as a baby bottle. The neck ring also retains a slide-fit valve sleeve on the base member for reciprocal motion between open and closed positions to respectively permit and prevent beverage flow from the bottle. A drinking mouthpiece such as a conventional nipple for infants or a ported spout for toddlers is mounted on the valve sleeve.

13 Claims, 4 Drawing Sheets

INFANT'S BOTTLE WITH VALVED CAP

BACKGROUND OF THE INVENTION

This invention relates generally to improvements in beverage containers such as baby bottles and drinking cups of a type used for feeding liquids to infants and toddlers. More specifically, this invention relates to an improved beverage container having a valved cap adapted for quick and easy movement between open and closed positions. The valved cap is adapted for use interchangeably with drinking mouthpieces suited for use by children of different ages.

A wide variety of baby bottles and beverage containers such as drinking cups and the like have been developed for use by infants and toddlers. For example, an infant's bottle traditionally comprises a bottle base having an open mouth covered by a resilient ported nipple. By contrast, drinking cups for toddlers typically include a beverage base or cup having a cap which incorporates a ported spout.

Beverage spilling has constituted a persistent problem encountered with drinking bottles and cups used by infants and small children. Such beverage containers are often transported in a filled or partially filled condition for convenient availability and beverage consumption by an infant or toddler. However, beverage leaking often occurs through the nipple or spout of the container, resulting in frequent contact of the beverage with articles such as clothing, furniture and upholstery, carpets and floors, etc. A significant need has existed for a simple and effective structure for positively closing the beverage container against undesired leakage, while permitting beverage consumption by a child in a normal manner.

In addition, as a child transitions from the infant to toddler stage, traditional baby bottles equipped with a ported resilient nipple are normally replaced by a cup or glass adapted for the child's advancing manipulative skills. In this regard, it has been common practice for parents to purchase replacement beverage cups for use by toddlers, with prior-acquired baby bottles falling into disuse. Prior beverage containers for infants and toddlers have not been designed for convenient interchangeable use by infants and toddlers, without requiring purchase of a new beverage container.

The present invention overcomes these problems and disadvantages encountered in the prior art by providing a beverage container for use by infants and toddlers, wherein the beverage container is equipped with a valved cap adapted for quick and easy movement between open and closed positions, and further wherein the valved cap is adapted for use with interchangeable drinking mouthpieces such as a nipple for an infant and/or a ported spout for a toddler.

SUMMARY OF THE INVENTION

In accordance with the invention, an improved beverage container for use by infants and toddlers is provided with a valved cap, in combination with a drinking mouthpiece which can be interchangeably selected according to the age and manipulative skill of the child. The valved cap comprises a pair of valve members mounted over the mouth of the beverage container and adapted for reciprocal sliding movement between open and closed positions. The drinking mouthpiece is mounted in turn onto one of the valve members and may comprise, for example, a resilient nipple for infants, or alternately a ported spout for toddlers.

In the preferred form of the invention, the valve members comprise a ported base member fitted over the mouth of the beverage container and defining a slide track for slide-fit reception of a ported valve sleeve. A threaded neck ring or the like overlies a slide joint between the base member and the valve sleeve to confine valve sleeve movement between the open and closed positions. The neck ring securely mounts the two valve members over the mouth of the beverage container, such as a baby bottle.

The drinking mouthpiece is mounted in turn onto the valve sleeve for reciprocal movement therewith between the open and closed positions. In one preferred form, the mouthpiece comprises a conventional infant's nipple mounted by a threaded mounting ring or the like onto the valve sleeve. In another preferred form, the mouthpiece comprises a ported spout having a threaded mounting ring segment for mounting onto the valve sleeve. The ported spout may be configured in a novelty shape, such as a character of a cartoon or action figure or the like. Moreover, the nipple and spout mouthpiece are interchangeable to accommodate replacement of the nipple with the spout mouthpiece as the child transitions from an infant stage to a toddler stage.

Other features and advantages of the present invention will become more apparent from the following detailed description, taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
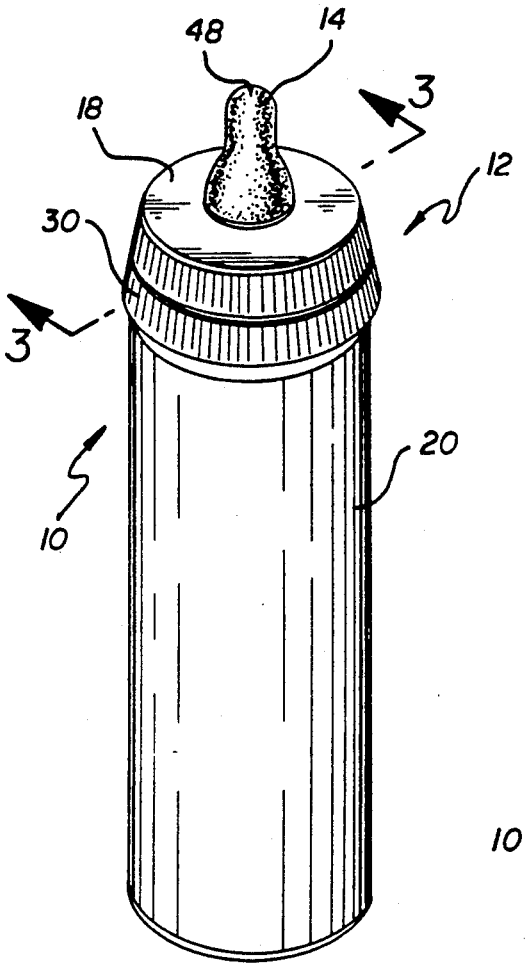
FIG. 1 is a perspective view illustrating an infant's bottle having a valved cap embodying the novel features of the invention, and illustrating the valved cap in a closed position.
Figure 2:
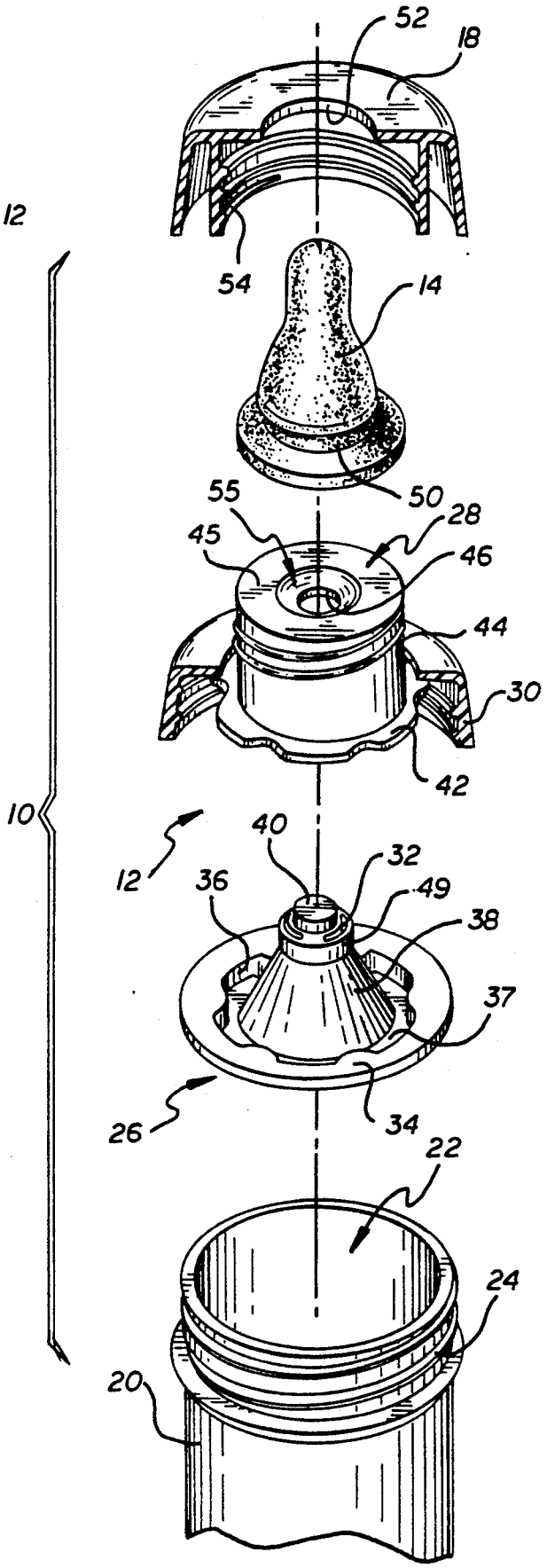
FIG. 2 is an enlarged fragmented and exploded perspective view illustrating the infant's bottle and valved cap of FIG. 1.
Figure 6:
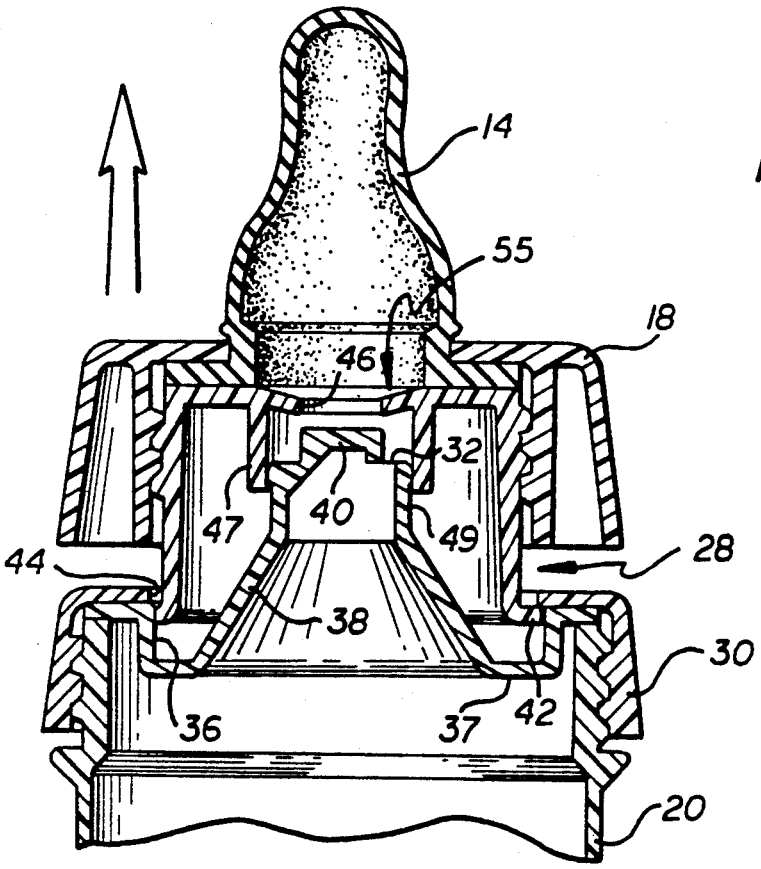
FIG. 6 is an enlarged fragmented vertical sectional view similar to FIG. 3, but illustrating the valved cap in an open position.
Figure 7:
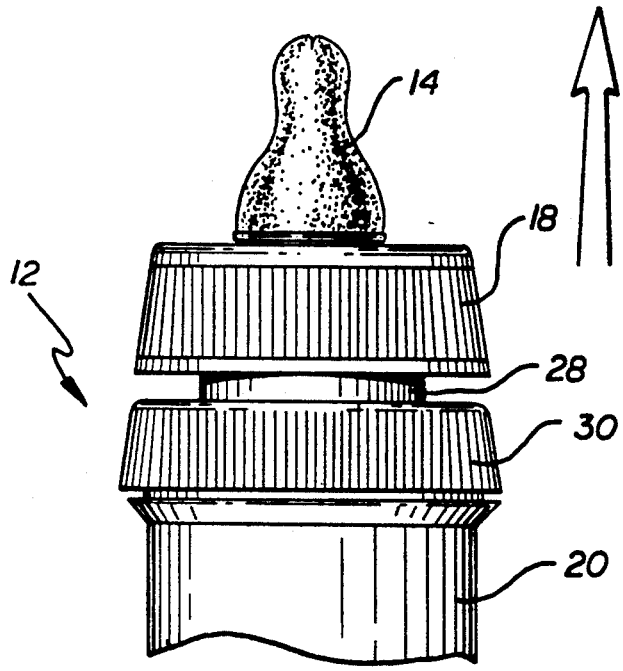
FIG. 7 is a fragmented front elevational view illustrating the infant's bottle and valved cap in the open position.

As shown in the exemplary drawings, a beverage container such as an infant's bottle referred to generally in FIG. 1 by the reference numeral 10 is equipped with a valved cap 12 movable quickly and easily between a closed position (FIG. 1) and an open position (FIG. 7). The bottle 10 is shown in FIGS. 1-7 with a mouthpiece in the form of a conventional infant's or nursing nipple 14. In the alternative, the valved cap 12 may be equipped with a ported spout 16 (FIGS. 8 and 9) for use by a toddler.

The valved cap 12 permits rapid and easy opening and closing of the bottle 10 for respectively permitting and preventing flow of a liquid beverage (not shown) via the selected mouthpiece. With reference to FIGS. 1 and 7, this opening and closing of the bottle is accomplished by displacing an upper neck or mounting ring 18 associated with the mouthpiece through a short linear stroke, generally along a vertical axis coincident with a central axis of the bottle 10. In the lowermost position, the valved cap 12 is positively closed and sealed against beverage flow or leakage of the beverage from the bottle interior. By contrast, in the upper position (FIG. 7), unobstructed beverage dispensing is permitted with the use of either one of the interchangeable mouthpieces.

The illustrative bottle 10 is shown in the form of a traditional baby bottle having an elongated and upwardly open hollow bottle body 20 defining an open mouth 22 which is circumscribed by an externally threaded neck 24. In this regard, the bottle body 20 may comprise a conventional baby bottle construction of wide-mouth design wherein the threaded neck 24 has a conventional and standardized geometry. Alternatively, the bottle body 20 may take other convenient forms, such as a shorter cup-shaped configuration, or any other suitable beverage container shape.

The valved cap 12 generally comprises a lower base member 26 retained over the bottle mouth 22 in combination with an upper valve sleeve 28, by means of a threaded neck ring 30. The valve sleeve 28 is retained by the neck ring 30 for sliding displacement in a reciprocal manner relative to the underlying base member 26, for purposes of opening and closing beverage flow ports 32 formed in the base member. The valve sleeve 28 is further adapted, as will be described, for removably supporting the selected mouthpiece.

More specifically, as shown best in FIGS. 2–5, the base member 26 includes a circular outer rim 34 having a size and shape for seated reception onto the upper margin of the bottle to extend across and close the bottle mouth 22. The rim 34 extends radially inwardly to a recessed slide track 36 of generally annular configuration circumscribing a generally annular base wall 37 which is joined in turn at its radially inner margin to an upwardly extending and hollow central cone 38. At an apex of the cone 38, the plurality of flow ports 32 are formed in an annular array about a nonperforated and upwardly protruding valve stem 40.

The valve sleeve 28 has a generally hollow cylindrical configuration which terminates in a lower edge defining an outwardly radiating flange 42 having a size and shape for slide-fit reception into the slide track 36 of the base member 26. In this regard, the outer peripheral shape of the flange 42 and the mating slide-track 36 are shown with a noncircular, generally scalloped geometry to prevent rotation of the valve sleeve 28 relative to the base member 26. The scalloped periphery defined by these components extends along an irregular line or slide joint which passes radially inwardly from and radially outwardly from an inner edge 44 of the lower neck ring 30. Thus, the threaded neck ring 30 is adapted for easy thread-on mounting onto the bottle body 20, with the inner edge 44 of the neck ring 30 providing an upper limit stop for the valve sleeve flange 42. The valve sleeve 28 is thus retained for linear reciprocation between an upper limit with the flange 42 engaging the underside of the neck ring 30, and a lower limit with the flange 42 rested upon the bottom or base wall 37 of the base member 26.

Figure 3:
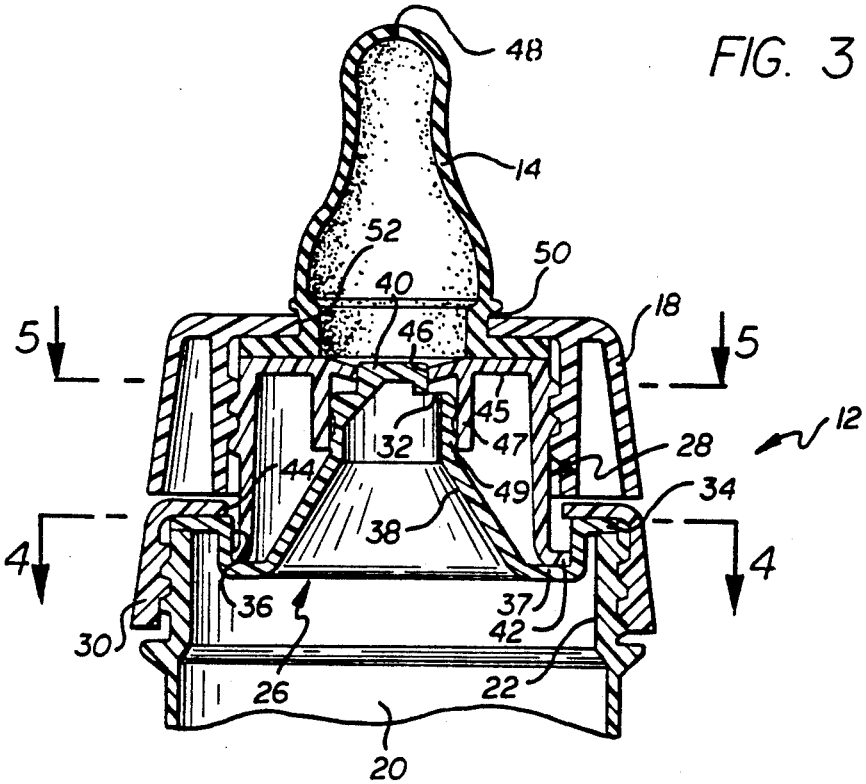
FIG. 3 is an enlarged fragmented vertical sectional view taken generally on the line 3—3 of FIG. 1.
Figure 4:
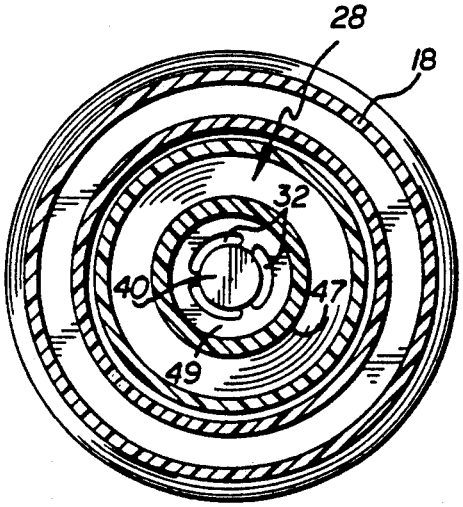
FIG. 4 is a horizontal sectional view taken generally on the line 4—4 of FIG. 3.
Figure 5:
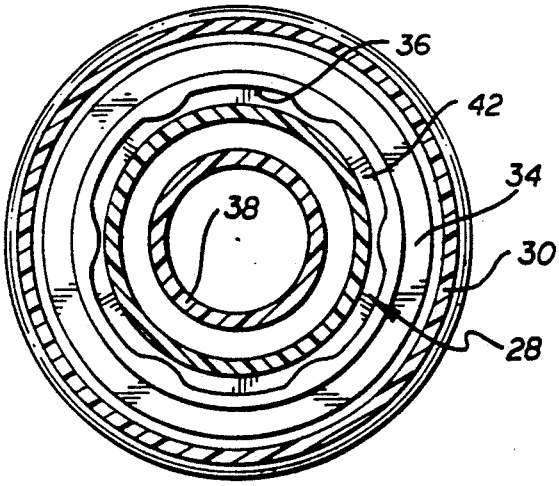
FIG. 5 is a horizontal sectional view taken generally on the line 5—5 of FIG. 3.

The valve sleeve 28 includes an upper end face 45 having a central flow aperture 46 formed therein with a size and shape for close-fitting reception of the stem 40 on the base member 26, when the valve sleeve 28 is pushed downwardly to the lowermost, closed position. This engagement of the stem 40 within the valve sleeve aperture 46, as shown in FIG. 3, effectively obstructs beverage passage through the flow ports 32. A depending seal ring 47 (FIGS. 3, 5 and 6) is provided for close-fitting engagement with a cylindrical segment 49 at the upper end of the cone 38 to prevent fluid leakage between the valve members 26, 28. Thus, in the lower position, the valve sleeve 28 effectively and positively closes the bottle to prevent beverage flow therefrom.

The nipple 14 comprises a conventional nursing nipple having a flow slit 48 at an upper end thereof. The nipple 14 is constructed from a resilient elastomer material for normal beverage drinking by an infant or the like. The nipple 14 includes a molded-in lock groove 50 near a lower end thereof for seated reception of an inner edge 52 of the upper mounting ring 18, which in turn includes a threaded segment 54 for thread-on mounting onto the cylindrical valve sleeve 28. In this regard, in the preferred form, the upper mounting ring 18 may conveniently comprise a conventional neck ring of the type used to mount a nursing nipple onto a small-mouthed bottle.

The valved cap 12 is movable quickly and easily to the open position as viewed in FIGS. 6 and 7, by mere upward lifting on the neck ring 18. Such upward motion is accompanied by upward displacement of the valve sleeve 28 through a short stroke, sufficient to displace the sleeve aperture 46 into spaced relation above the base member stem 40. The flow ports 32 are thus opened, to permit normal dispensing and drinking of a beverage from the bottle interior. The beverage is free to flow through the base member flow ports 32 and further through the valve sleeve aperture 46 to the interior of the nipple 14. It is noted that a portion of the upper end face 45 of the valve sleeve 28 surrounding the flow aperture 46 is downwardly dished, as indicated by arrow 55, so that residual beverage within the hollow interior of the nipple 14 may drain quickly and easily back into the bottle interior.

Figure 8:
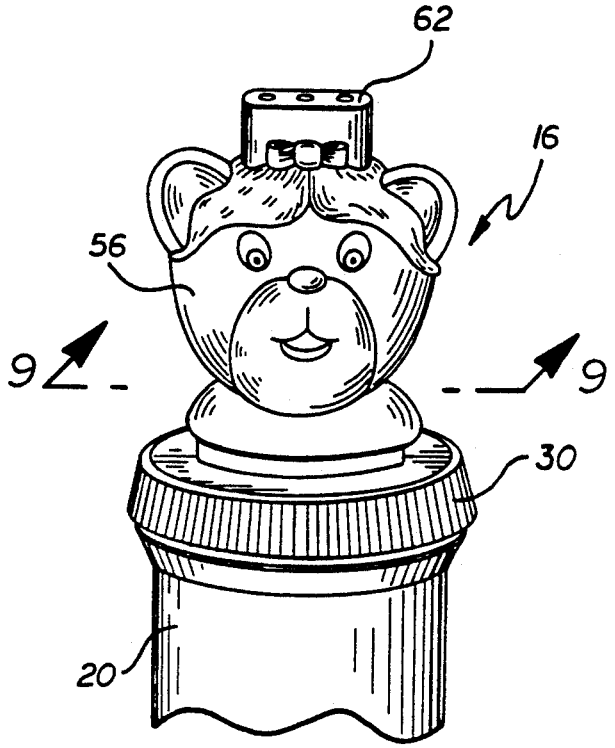
FIG. 8 is a fragmented front perspective view depicting the valved cap with an alternative drinking mouthpiece mounted thereon.
Figure 9:
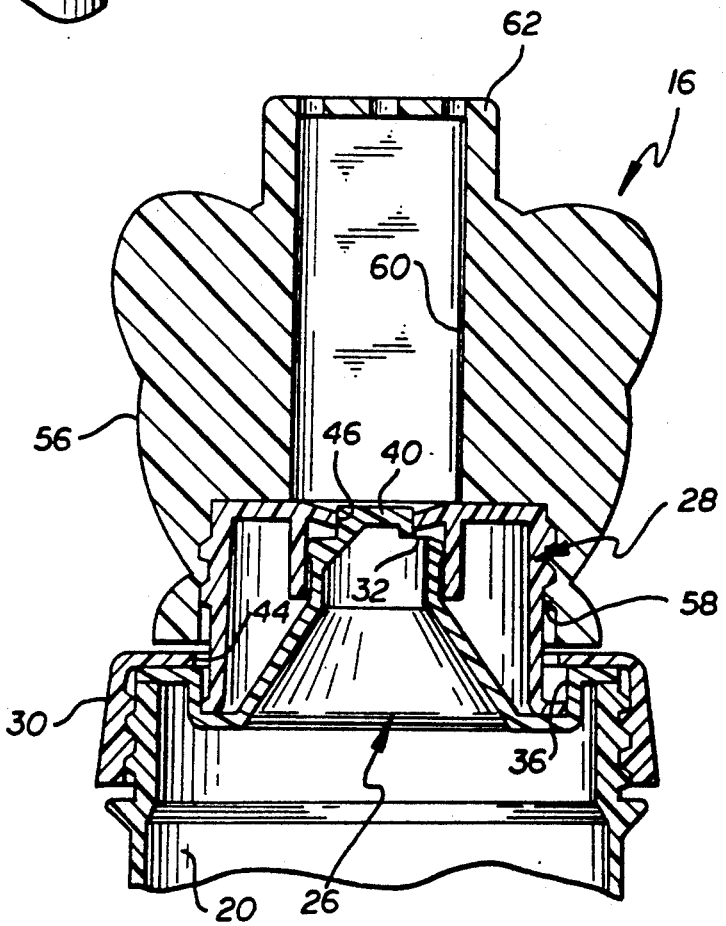
FIG. 9 is an enlarged fragmented vertical sectional view taken generally on the line 9—9 of FIG. 8.

The alternative mouthpiece is shown in FIGS. 8 and 9, in the form of the ported spout 16 adapted for beverage drinking by toddlers. The ported spout 16 is conveniently designed for direct thread-on mounting onto the valve sleeve 28 of the valved cap 12, all as previously described with respect to FIGS. 1–7. More particularly, the nipple 14 and associated mounting ring 18 can be removed by simple thread-off displacement with respect to the valve sleeve 28, followed by simple thread-on mounting of the ported spout 16.

FIGS. 8 and 9 illustrate one preferred form of the ported spout which may be constructed from a lightweight and economical plastic molding, preferably in the form of a novelty figure such as a cartoon character or action FIG. 56 or the like. The ported spout 16 has an internally threaded lower end segment 58 for thread-on mounting onto the valve sleeve 28, and a hollow interior 60 leading to a multiported tip 62 shaped for convenient drinking of beverages by toddlers. The valved cap 12 is again opened and closed quickly and easily, by mere vertical reciprocation movement of the ported spout 16, for purposes of displacing the underlying valve sleeve 28 through its vertical stroke, all in the manner as previously described.

A variety of further modifications and improvements to the infant's bottle of the present invention will be apparent to those skilled in the art. Accordingly, no limitation on the invention is intended by way of the foregoing description and accompanying drawings, except as set forth in the appended claims.

What is claimed is:

1. A valved cap for use with a beverage container, comprising:

a first valve member having at least one flow port formed therein;

a second valve member;

means for mounting said second valve member on said first valve member for reciprocal movement between a first position closing said flow port and a second position opening said flow port;

means for mounting said first and second valve members onto the beverage container, whereby movement of said first valve member between said first and second positions respectively prevents and permits flow of a beverage from the beverage container through said flow port;

a plurality of different mouthpieces interchangeable for mounting one at a time onto said second valve member; and means for removably mounting a selected one of said mouthpieces on said second valve member.

2. The valved cap of claim 1 wherein one of said mouthpieces comprises a nursing nipple for an infant.

3. The valved cap of claim 1 wherein one of said mouthpieces comprises a ported spout.

4. The valved cap of claim 1 wherein one of said mouthpieces comprises a ported spout having a novelty figure shape.

5. A valved cap for use with a beverage container, comprising:

a first valve member having at least one flow port formed therein;

a second valve member;

means for mounting said second valve member on said first valve member for movement between a first position closing said flow port and a second position opening said flow port;

means for mounting said first and second valve members onto the beverage container, whereby movement of said first valve member between said first and second positions respectively prevents and permits flow of a beverage from the beverage container through said flow port; and a plurality of different mouthpieces interchangeable for mounting one at a time onto said second valve member; and means for removably mounting a selected one of said mouthpieces on said second valve member;

said plurality of different mouthpieces comprising a nursing nipple for an infant and a ported spout.

6. A valved cap for use with a beverage container, comprising:

a base member adapted for mounting onto the beverage container in a position to extend over and close a mouth of the beverage container, said base member having at least one flow port formed therein and defining a slide track having a noncircular peripheral shape;

a valve sleeve including slide-means having a noncircular peripheral shape for substantially mating fit with said slide track, said slide-means being guidably fitted with said slide track for reciprocal movement of said valve sleeve relative to said base member;

neck ring means for mounting onto the beverage container, said neck ring means including an inner edge disposed such that said noncircular peripheries of said slide track and said slide-means extend radially inwardly from and radially outwardly from said inner edge whereby said neck ring means retains said base member and said valve sleeve on the beverage container, said valve sleeve being slidably reciprocal between a first position closing said flow port to prevent flow of a beverage from the beverage container through said flow port, and a second position opening said flow port to permit flow of the beverage from the beverage container; and a mouthpiece including means for removably mounting onto said valve sleeve.

7. The valved cap of claim 6 wherein said base member defines one end stop for sliding movement of said valve sleeve along said slide track, and further wherein said neck ring means defines an opposite end stop for sliding movement of said valve sleeve along said slide track.

8. The valved cap of claim 6 wherein said base member includes a nonperforated valve stem having a size and shape for sealed reception into a flow aperture formed in said valve sleeve when said valve sleeve is in said first position.

9. The valved cap of claim 8 when said flow aperture is formed in an end face of said valve sleeve, said end face including a dished segment circumscribing said flow aperture.

10. The valved cap of claim 6 wherein said mouthpiece comprises a nursing nipple for an infant.

11. The valved cap of claim 6 wherein said mouthpiece comprises a ported spout.

12. The valved cap of claim 6 wherein said mouthpiece comprises a ported spout having a novelty figure shape.

13. The valved cap of claim 6 wherein said mouthpiece comprises a plurality of different mouthpieces interchangeable for mounting one at a time onto said second valve member.

* * * * *